US007905684B2

(12) United States Patent
Torkildsen

(10) Patent No.: US 7,905,684 B2
(45) Date of Patent: Mar. 15, 2011

(54) OFFSHORE POWER PLANT

(76) Inventor: Odd Bernhard Torkildsen, Oslo (NO)

( * ) Notice: Subject to any disclaimer, the term of this patent is extended or adjusted under 35 U.S.C. 154(b) by 156 days.

(21) Appl. No.: 12/443,510

(22) PCT Filed: Oct. 6, 2006

(86) PCT No.: PCT/NO2006/000345

§ 371 (c)(1),
(2), (4) Date: Mar. 30, 2009

(87) PCT Pub. No.: WO2008/041856

PCT Pub. Date: Apr. 10, 2008

(65) Prior Publication Data

US 2010/0071606 A1 Mar. 25, 2010

(51) Int. Cl.
*B63B 35/44* (2006.01)

(52) U.S. Cl. ..... 405/210; 114/264

(58) Field of Classification Search ..... 114/264–266; 405/204, 210

See application file for complete search history.

(56) References Cited

U.S. PATENT DOCUMENTS

| | | | | |
|---|---|---|---|---|
| 2,875,833 | A | 3/1959 | Martin | |
| 4,188,157 | A * | 2/1980 | Vigander | 405/210 |
| 4,422,803 | A * | 12/1983 | Wetmore | 405/204 |
| 4,679,627 | A | 7/1987 | Harrison | |
| 6,814,946 | B1 * | 11/2004 | Peddicord et al. | 422/275 |
| 2003/0140838 | A1 | 7/2003 | Horton, III | |

* cited by examiner

*Primary Examiner* — Stephen Avila
(74) *Attorney, Agent, or Firm* — David A. Guerra

(57) ABSTRACT

Platform for a power plant equipped for producing oil and made of reinforced concrete to reduce maintenance cost, consisting of at least one module. Each module will consist of at least one circular column surrounded by concrete to create a desired outer surface. Any of the columns can be used to store the petroleum (oil, gas, production water, sand, etc.), act as expansion chamber(s) and act as passive ballast or separation tank. The platform will have at least one deck for oil producing equipment, at least one deck for a power plant, and will have equipment necessary for electric power distribution.

17 Claims, 4 Drawing Sheets

OFFSHORE POWER PLANT

CROSS-REFERENCE TO RELATED APPLICATIONS

This application is an U.S. national phase application under 35 U.S.C. §371 based upon co-pending International Application No. PCT/NO2006/000345 filed on Oct. 6, 2006. Additionally, this U.S. national phase application claims the benefit of priority of co-pending International Application No. PCT/NO2006/000345 filed on Oct. 6, 2006. The entire disclosures of the prior applications are incorporated herein by reference. The international application was published on Apr. 10, 2008 under Publication No. WO 2008/041856.

BACKGROUND OF THE INVENTION

1. Field of the Invention

The present invention relates to a platform which produce electric power, more specific an oil or/and gas producing platform holding its own power plant on one of its upper decks.

2. Description of the Prior Art

Productions of hydrocarbons (oil and gas) is normally done through concepts consisting of platforms either floating or standing on the seabed or by use of special purpose built ships.

Today power plants are positioned onshore with a fuel supply from a hydrocarbon source. This source could be either through a pipeline from a platform or it could be from a hydrocarbon storage facility nearby. The energy generated by the power plant is then transported across a power energy network to the end user.

One of the negative aspects of power plants using hydrocarbon fuel today is the CO2 outlets through the exhaust. Today it is known that CO2 gas influence the weather and temperature and thus a threat to the environment. The handing of CO2 has become an expensive and difficult task to clean before the exhaust fumes can be let out into the air. Furthermore, it is very expensive to transport hydrocarbons from an oil producing facility offshore to an onshore facility either through permanent pipelines or by vessel and thus contribute considerably to the cost of producing electric power using hydrocarbons.

SUMMARY OF THE INVENTION

Thus, the main objective with present invention is to provide an offshore platform which is constructed with an eye to reduce the cost of transporting hydrocarbons on shore and getting rid of CO2 gas without adding it to the atmosphere and causing further environmental problems. This is achieved with the platform according to present invention as it is defined in the claims.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
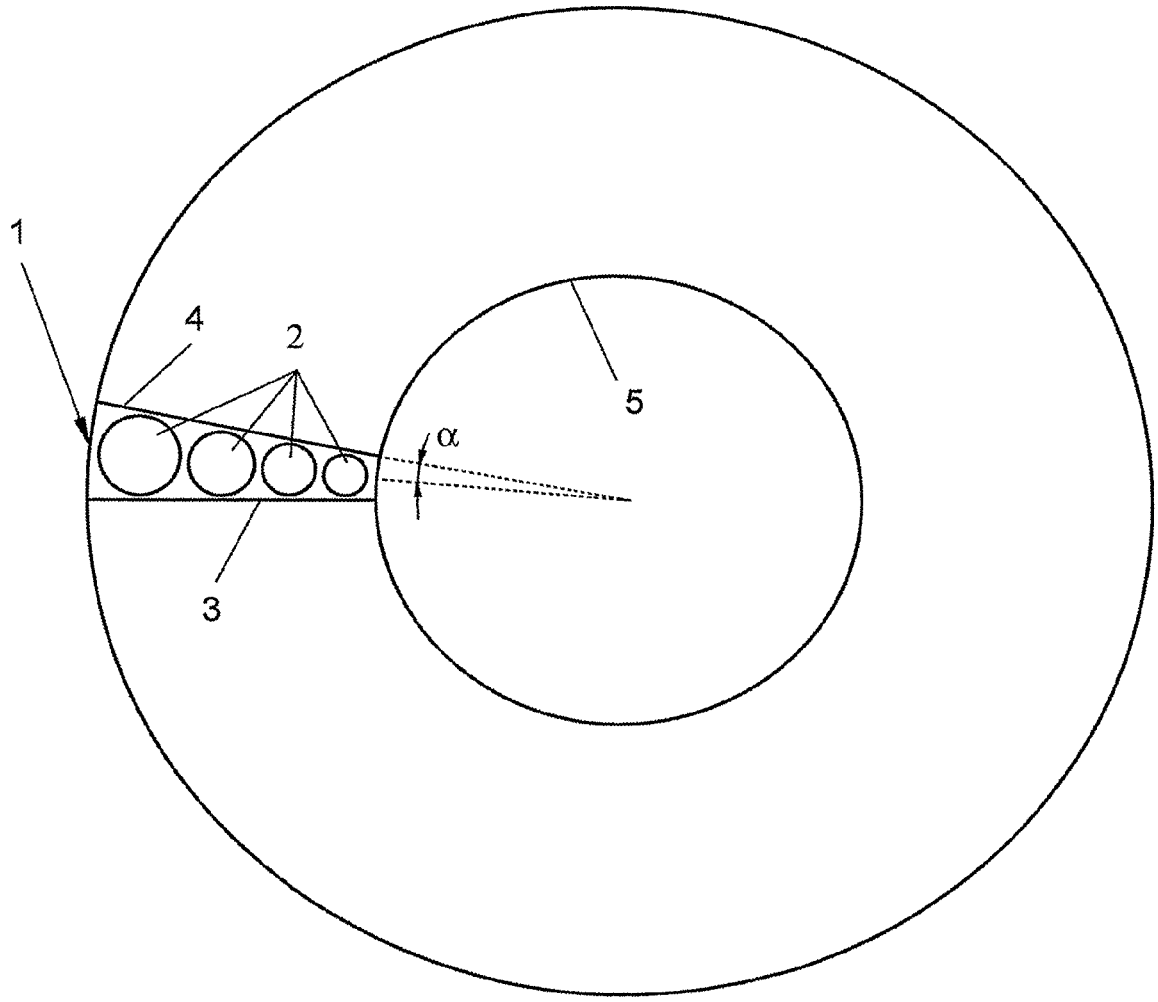
FIG. 1 is a cross section of a separate module.
Figure 2:
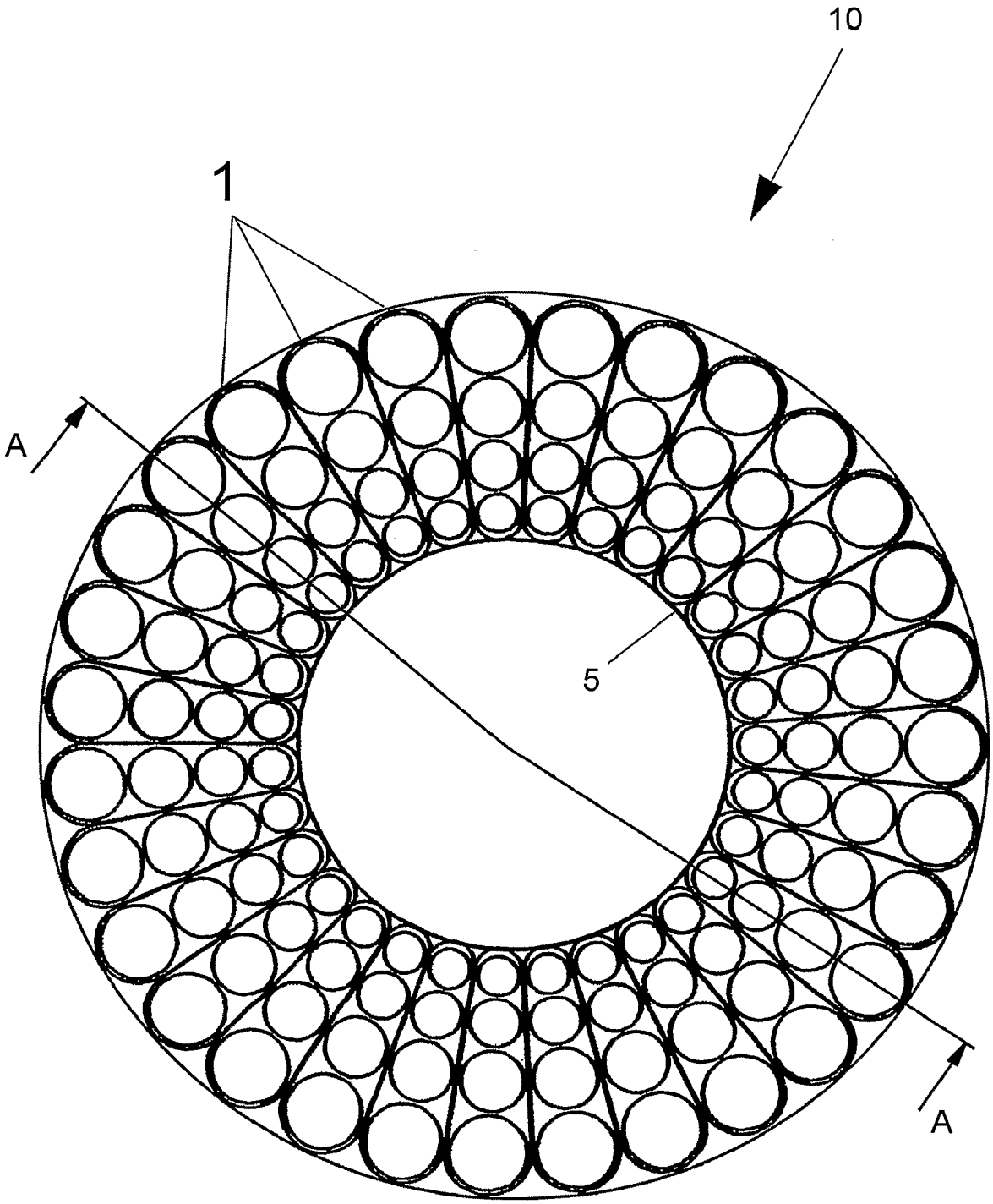
FIG. 2 is a horizontal cross section of a completed platform.
Figure 3:
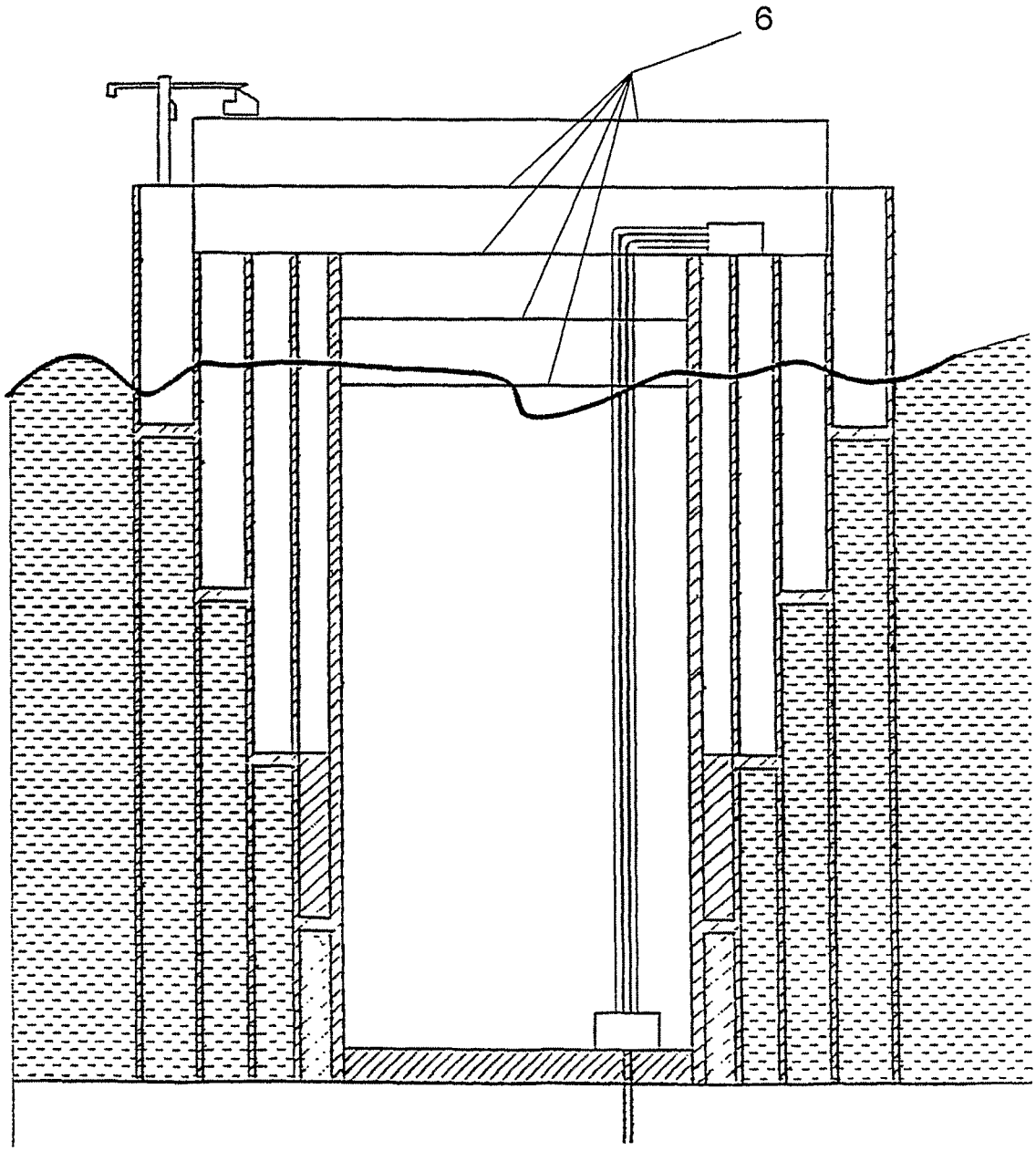
FIG. 3 is a vertical cross section A-A of the platform showing the circular columns partly filled with oil or ballast.

With reference to FIGS. 1, 2, 3 and 4. A platform 10 according to the invention will consist of a circle of modules 1, each module consisting of at least one of circular column 2, with the same or different size of diameter, surrounded by concrete to create a desired outer surface. The straight sides 3, 4 of the module will have an angle [alpha] given by the number of modules 1 the platform 10 shall consist of and thus giving the size of the platform. The modules will be held together by some fixing means, like bolts or similar. The internal circular "column" 5 generated by the modules 1 in the middle of the platform 10 can be either sealed at the bottom and be used for storage of oil, gas, etc. or nothing, or completely filled with the water surrounding the platform. The modules may be put together in a sealing way so that the central space of the platform can be utilized as desired. The production of a module 1 is based on the Norwegian patent 162 255 for building bridges submerged in water (fresh or sea water). The Norwegian patent 162 255 describes a method for producing these circular columns 2 in a rational and economical way. However, the method is not essential for the end result, so other methods available can be used. When all the modules 1 have been produced and put in place to create the complete platform 10, it is then taken offshore, positioned and either lowered down to the seabed on top of one or more production wells for oil and or gas, anchored in position like a floating vessel/platform, or "tied" down like a tension-leg platform.

The production of this type of platform 10 is much cheaper than the method used for known platforms like a Condeep where the use of a sliding frame which is moved in the vertical direction which results in a higher cost and more difficult process of providing concrete at a steady pace. The known techniques for such sliding frames require high level of man power compared to the technique described in the Norwegian patent 162 255.

As the modules 1 are produced they are simply turned 90[deg.] into a vertical position and put in the respective radial position until the platform 10 has reached its final dimension/size.

Some of the advantages with this type of platform relative to the known concepts utilized today are, a) expansion chambers (i.e. one of the circular columns 2) can be utilized in stead of a flare system, b) the internal volume of the platform makes it possible to utilize passive separation for separation of production water, and c) through the vertical circular columns 2 it can be carried out dry drilling (i.e. not subsea/subwater drilling) which reduces the danger for uncontrolled blowouts. Any leakage in or collapse of one or more of the circular columns 2 will not necessarily be critical for the platform 10 when it comes to lack of buoyancy etc., because of the number of circular columns 2 the platform 10 consist of.

On at least one of the deck 6 to the platform 10 there will be a processing plant adapted to the type of hydrocarbons being produced, in addition to the power plant. The oil and/or gas which normally would have been transported either by a vessel or by a pipeline to an oil refinery/storage facility onshore will now be fed to an onboard storage tank. This storage tank could be at least one or more of the vertical circular columns 2. When the oil/gas are placed in one or more of these columns at a high temperature, a natural horizontal separation will take place in that or those columns 2, hereafter referred to as the separation tank 12.

The different quality of hydrocarbon will be used for specific engines suitable for that type of fuel. The engines will drive a generator to produce electric power. In the separation tank 12 will sand and/or debris 13 be taken out and deposited. Any water from the production, production water 14, will be drained out and used for reinjection 24. The power production can be carried out by use of different type of engines 18. However to simplify the description we have only described the process by use of diesel engines, but the process would be the same with the use of other types of engines.

Figure 4:
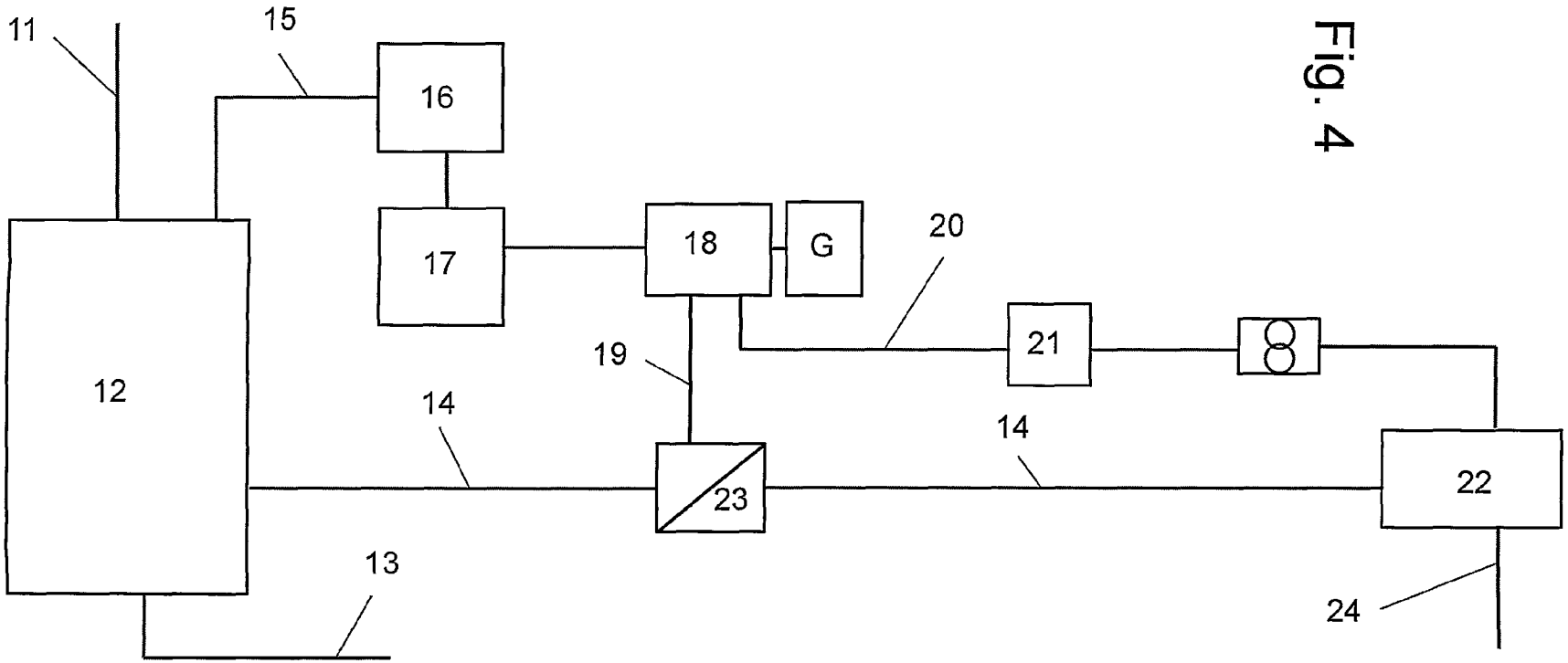
FIG. 4 is a block diagram of an additional process on the platform which will be carried out in connection with the power plant.

With reference to FIG. 4. Oil and/or gas 11 from the oil well are allowed to separate in the separation tank 12. Sand/debris 13 and production water 14 is taken out from the separation tank 12. The separated oil and gas 15 is lead to the process plant 16 on the platform for production of fuels which are stored in the fuel tanks 17. The fuel for the diesel engines will be taken from the fuel tank and supplied to the diesel engines 18. The diesel engine cooling water 19 and exhaust gas 20 will be used to heat up the production water 14. When the exhaust gas have been through a dry filter 21 to remove debris, the exhaust gas 20 and the production water 14 are put under high pressure by a compressor 22 for injection 24. By adding the exhaust gas 20 and the temperature transfer 23 from the cooling water 19 of the diesel engine 18 to the production water 14 will combined create very high efficiency when injected back into the reservoir. The advantage with this method is that the mixture of water and oil remnants 14 together with the exhaust gas 20 which include CO2, having a high temperature, will better dissolve the oil and gas within the reservoir when injected.

However, the most important reason for returning the exhaust gas 20 is that it would be deposited in its entirety at a low cost and the withdrawal from the reservoir will be increased. This process is feasible because the present invention has a very large storage capacity. No other platform today has this opportunity.

Another advantage with the present invention is that there exists no need for transportation of the hydrocarbons to an onshore facility, either through pipelines or by use of vessels. The distribution network for electric power is much cheaper to install and do not hold such a threat environmental pollution as a pipeline or vessel do.

The invention claimed is:

1. A platform system for an oil or gas producing power plant, said platform comprising:

at least one module, said module comprising a plurality of circular columns each having a different diameter, said columns being surrounded by concrete to create a desired outer surface; and at least one deck positionable on said module and adapted to support oil producing equipment;

wherein at least one of said columns being adapted to store therein a fluid from a reservoir and act as a passive separation tank;

wherein said fluid stored in at least one of said circular columns is seawater which is adapted to provide desirable buoyancy and stability for said platform based on weight distribution;

wherein at least one of said circular columns is an expansion chamber to cater for variable production pressure from said fluid.

2. The platform as set forth in claim 1, wherein said platform system comprising a plurality of modules, wherein adjacent modules being attachable to each other radially and sealed to form an internal circular column.

3. The platform as set forth in claim 2, wherein said internal circular column being sealed at its bottom and adapted to store a fluid therein.

4. The platform as set forth in claim 1, wherein at least one of said circular columns is a storage tank for production water.

5. The platform as set forth in claim 4 further comprising a power plant locatable on said deck, said power plant being at least one engine.

6. The platform as set forth in claim 5 further comprising a fuel tank.

7. The platform as set forth in claim 5, further comprising a compressor adapted to inject said production water and said exhaust into said reservoir by pressure.

8. The platform as set forth in claim 7, wherein said production water and said exhaust injected into said reservoir are treated with 15000 Hz to produce an emulsion adapted to dissolve said fluid in said reservoir.

9. The platform as set forth in claim 7 further comprising a dry filter adapted to remove debris from said exhaust.

10. A power plant platform system comprising:

a plurality of modules radially attachable and sealed to each other to form an internal circular column, each of said modules comprising a plurality of circular columns surrounded by concrete to create a desired outer surface;

at least one deck positionable on said modules and adapted to support oil producing equipment;

a power plant locatable on said deck, said power plant comprising at least one engine and at least one fuel tank in fluid communication with said engine;

a compressor adapted to inject production water and exhaust from said engine into an oil reservoir;

a dry filter adapted to remove debris from said exhaust;

wherein at least one of said columns being adapted to store therein a fluid from said oil reservoir and act as a passive separation tank;

wherein at least one of said circular columns being adapted to store seawater to provide desirable buoyancy and stability for said power plant platform system based on weight distribution;

wherein at least one of said circular columns being an expansion chamber to cater for variable production pressure from said fluid;

wherein at least one of said circular columns being a storage tank for said production water.

11. The platform as set forth in claim 10, wherein said circular columns of each of said modules each having a different diameter.

12. A method of using a power plant platform system, said method comprising the steps of:

(a) providing a power plant platform system comprising: modules including circular columns surrounded by concrete to create a desired outer surface; and at least one deck positionable on said modules and adapted to support oil producing equipment; wherein at least one of said columns is a separation tank, and at least one of said columns is an expansion chamber;

(b) transferring fluid from a reservoir into said separation tank and separating said fluid in said separation tank into oil and gas, production water, and debris;

(c) transferring said oil and gas from said separation tank to a process plant;

(d) transferring said production water from said separation tank to a temperature transfer;

(e) producing fuel in said process plant from said oil and gas;

(f) supplying said fuel to at least one engine located on said deck;

(g) heating said production water in said temperature transfer using cooling water and exhaust from said engine; and (h) injecting said production water heated by said temperature transfer and a portion of said exhaust back into said reservoir to increase the dissolving of said fluid in said reservoir.

13. The platform as set forth in claim 11 further comprising the step, before step (b), of storing seawater in at least one of said circular columns to provide desirable buoyancy and stability for said power plant platform system based on weight distribution.

14. The platform as set forth in claim 11 further comprising the step, before step (f), of transferring said fuel to at least one fuel tank for supplying said fuel to said engine.

15. The platform as set forth in claim 11 further comprising the step, before step (e), of transferring said debris out from said separation tank, and the step of, before step (h), removing debris from said exhaust using a dry filter.

16. The platform as set forth in claim 11 further comprising the step, before step (h), of treating said production water and said exhaust with 15000 Hz to produce an emulsion adapted to dissolve said fluid in said reservoir.

17. The platform as set forth in claim 11 further comprising the step, before step (h), of increasing the production life of said reservoir by adding said exhaust and said production water back into said reservoir.

* * * * *